US012590715B2

(12) United States Patent
Mountford

(10) Patent No.: US 12,590,715 B2
(45) Date of Patent: Mar. 31, 2026

(54) AIR CONDITIONER CONDENSER UNIT

(71) Applicant: Daniel S. Mountford, Wichita, KS (US)

(72) Inventor: Daniel S. Mountford, Wichita, KS (US)

( * ) Notice: Subject to any disclaimer, the term of this patent is extended or adjusted under 35 U.S.C. 154(b) by 56 days.

(21) Appl. No.: 18/736,926

(22) Filed: Jun. 7, 2024

(65) Prior Publication Data

US 2024/0361010 A1 Oct. 31, 2024

(51) Int. Cl.
*F24F 1/18* (2011.01)

(52) U.S. Cl.
CPC ..... *F24F 1/18* (2013.01)

(58) Field of Classification Search
CPC .. F25B 2339/041; F25B 2339/046; F24F 1/42
USPC ..... 62/498
See application file for complete search history.

(56) References Cited

U.S. PATENT DOCUMENTS 4,069,687 A * 1/1978 Larriva ..... F25B 39/04 62/428
4,490,993 A * 1/1985 Larriva ..... F25B 39/04 62/304
5,832,739 A * 11/1998 Bacchus ..... F25B 39/04 62/305
2006/0042294 A1* 3/2006 Bacchus ..... F28D 5/02 62/305
2011/0168362 A1* 7/2011 Hall ..... F28D 1/0426 165/121

* cited by examiner

*Primary Examiner* — Steve S Tanenbaum
(74) *Attorney, Agent, or Firm* — Kenneth H. Jack; Davis & Jack. L.L.C.

(57) ABSTRACT

An air conditioner condenser unit incorporating a refrigerant compressor having an output port communicating with an output tube; having a matrix of refrigerant condensing tubes with an input port communicating with the refringent compressor's output tube; having a plurality of evaporative cooling panels which outwardly overlie the matrix of refrigerant condensing tubes; having a blower positioned for inwardly drawing air through the evaporative cooling panels, and toward the matrix of refrigerant condensing tubes; and having a water reservoir for supplying water to the evaporative cooling panels, the water reservoir housing a submersible water pump and receiving a lower end of the refrigerant condensing tubes.

16 Claims, 4 Drawing Sheets

AIR CONDITIONER CONDENSER UNIT

FIELD OF THE INVENTION

This invention relates to commercial and residential refrigerant based air conditioning systems. More particularly, this invention relates to such systems which incorporate an out-of-doors refrigerant liquifying and heat dissipating condenser unit.

BACKGROUND OF THE INVENTION

Outdoor units of commercial and residential air conditioning systems commonly incorporate a refrigerant condenser coil which receives the heated and pressurized gaseous refrigerant output of an electric motor-powered compressor. Such air conditioner system condenser coils and compressors are typically housed within a casing situated next to an outside wall of a building served by the system. Such outdoor unit casings commonly house an electric motor driven fan which draws ambient outside air inwardly into the case, then further inwardly through and over the unit's condenser coils. Hot compressor driven gaseous refrigerant is cooled by the air which courses over the condenser coils. As a result of such air flow effected cooling, the refrigerant undergoes a phase change from gas to liquid within the inner channels of the condenser coil.

Where the ambient outside air is hot, typically during summer months, the above-described direct air cooling mode of heat exchange is commonly inefficient and energy wasting, undesirably resulting in the transmission of excessively warm liquid refrigerant to the system's indoor evaporator unit.

The instant inventive air conditioner condenser unit solves or ameliorates such deficiencies by incorporating within an air conditioning system's outdoor condenser unit evaporative cooling panels which allow the refrigerant cooling air flow to additionally perform evaporative cooling prior to the air's passage over the unit's condenser coil.

BRIEF SUMMARY OF THE INVENTION

A central structural component of the instant inventive air conditioner condenser unit comprises a refrigerant compressor. In a preferred embodiment, the refrigerant compressor includes within its housing an electric motor which drives the units' compressor's interior refrigerant compressing element. Such refrigerant compressing element may suitably comprise a piston which reciprocates within a cylinder to pump and compress the gaseous refrigerant. Alternatively, the compressor may incorporate a scroll, rotary, or centrifugal refrigerant compressing element. In a preferred embodiment, the refrigerant compressor is housed and supported within a free-standing outdoor air conditioner unit case, such case further housing the system components described below.

A further structural component of the instant inventive air conditioner condenser unit comprises a condenser coil or matrix of refrigerant condensing tubes. The condenser coil component of the instant inventive unit may suitably adopt a multiply turning "S" bend configuration, which includes multiplicities of heat conducting fins spanning between the tubes' multiple turns. However, in the preferred embodiment, the refrigerant coil comprises a matrix of refrigerant condensing tubes which incorporates upper and lower tube configured manifolds, and a plurality of substantially vertically extending connector tubes spanning between the manifolds. In the preferred embodiment, the compressed gas output of the refrigerant compressor initially communicates with the refrigerant tube matrix's upper manifold for distribution to upper or relatively warm ends of the connector tubes. An output port preferably opens the lower manifold which communicates with the connector tubes' lower and relatively cool ends, such output port communicating with a refrigerant line which extends into the building. Within the building, the refrigerant undergoes further cooling within the air conditioning system's indoor refrigerant evaporator coil.

Further structural components of the instant inventive air conditioner condenser unit comprise at least a first, and preferably an additional plurality of second evaporative cooling pads or panels. Each of the unit's evaporative cooling panels preferably includes a porous or fibrous interior matrix which allows downward flows of water therethrough, and which allows simultaneous lateral flows of air therethrough. Such panels may suitably comprise bodies of open cell polyester foam, *excelsior*, or wood wool.

Air drawn inwardly into the case by an electric motor driven fan courses horizontally through the evaporative cooling panels, continuously evaporating water which flows downwardly therethrough. Liquid-to-gas phase changes (i.e. liquid water to water vapor) occurring within the panels advantageously produce an inwardly flowing cooled air output. In a preferred embodiment, the unit's evaporative cooling panels are supported at and span across air inlet ports which open the unit's case at its outer, lateral or side walls.

A further structural component of the instant inventive air conditioner condenser unit comprises an air blower which is positioned for drawing ambient outside air inwardly into the case and through the evaporative cooling panels. Air cooled by the evaporative cooling panels courses further inwardly into the casing to flow over and about the matrix of refrigerant condensing tubes, efficiently cooling the heated and compressed refrigerant therein.

A further structural component of the instant inventive air conditioning unit preferably comprises a water reservoir which is mounted and supported at a lower end of the interior of the unit's casing. In the preferred embodiment, lower ends of the refrigerant condensing tubes are immersed within chilled water which is collected within the reservoir. The chilled water output of the lower ends of the evaporative cooling panels is stored within the reservoir, such water further cooling the heated refrigerant within the matrix of refrigerant condensing tubes.

In operation of the instant inventive air conditioner condenser unit, air which is drawn by the blower into the case is cooled by the evaporative cooling panels prior to the air's further inward passage over the matrix of refrigerant condensing tubes. The evaporatively cooled air passes directly over upper ends of such tubes, efficiently cooling the heated refrigerant therein. The chilled water output of the evaporative cooling panels collected within the reservoir simultaneously bathes the lower ends of the refrigerant condensing tubes, further efficiently cooling the refrigerant within the refrigerant condensing tubes. Accordingly, the instant inventive air conditioner condenser unit advantageously applies dual modes of refrigerant cooling heat exchange to the unit's coils including direct contact with evaporatively cooled air and direct contact with a chilled body of water produced by the evaporative cooling process.

Accordingly, objects of the instant invention include the provision of an air conditioner condenser unit which incorporates structures as described above, and which arranges those structures in relation to each other in the manners described above for the performance of beneficial functions as described above.

Other and further objects, benefits, and advantages of the instant invention will become known to those skilled in the art upon review of the detailed description which follows, and upon review of the appended drawings.

DETAILED DESCRIPTION OF A PREFERRED EMBODIMENT

Figure 1:
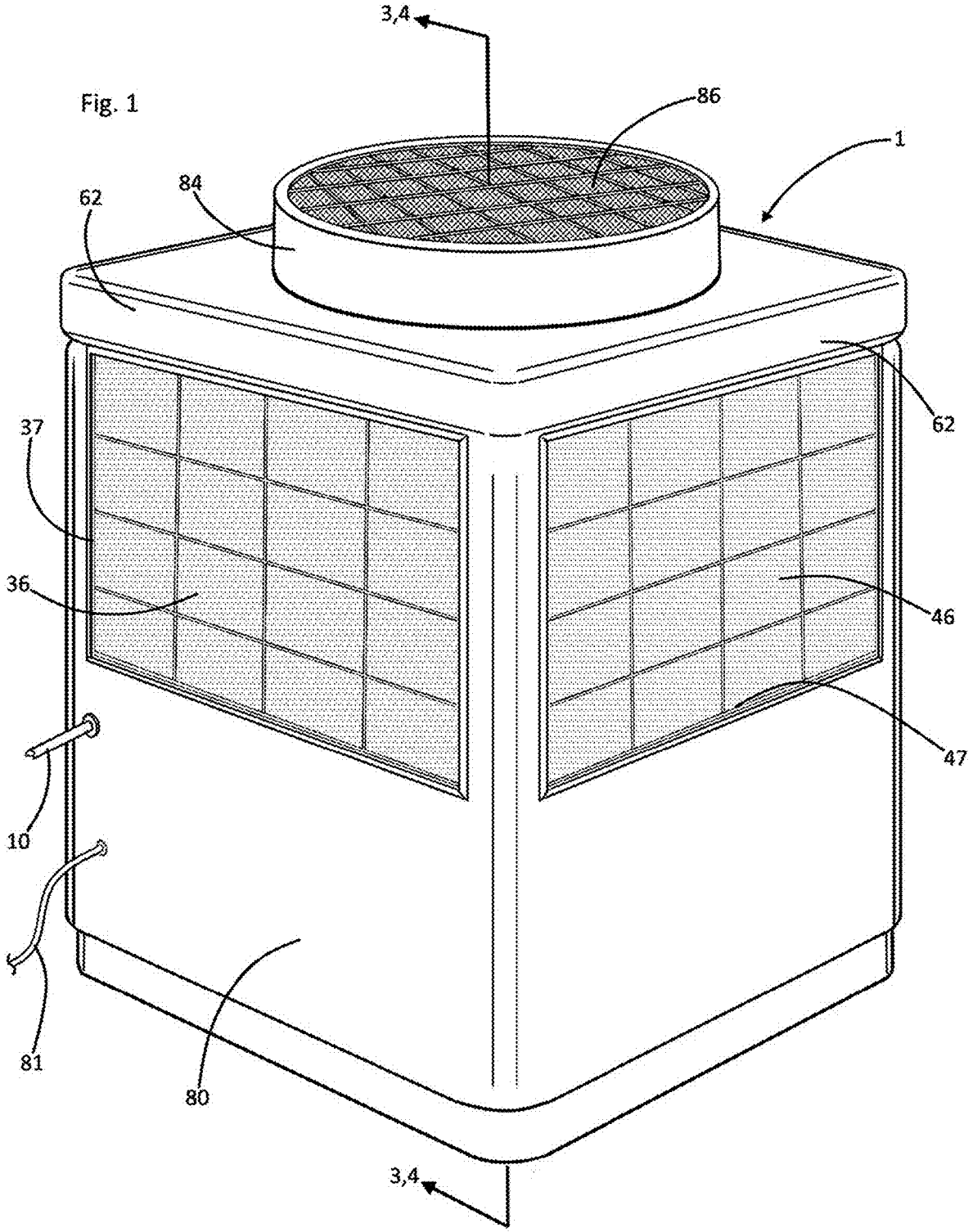
FIG. 1 is a perspective view of a preferred embodiment of the instant inventive air conditioner condenser unit.
Figure 2:
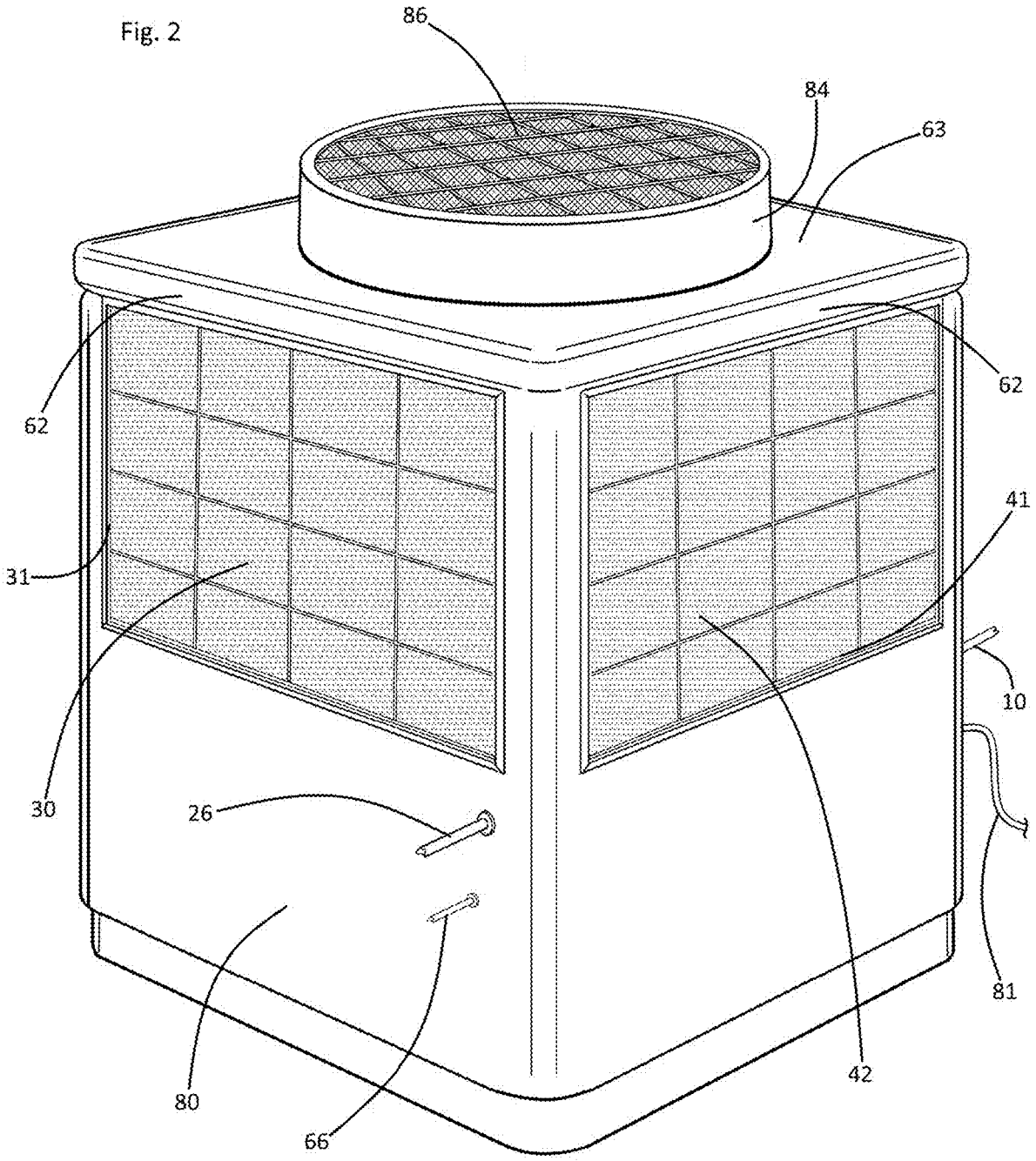
FIG. 2 is a reverse perspective view of the air conditioner condenser unit of FIG. 1.
Figure 3:
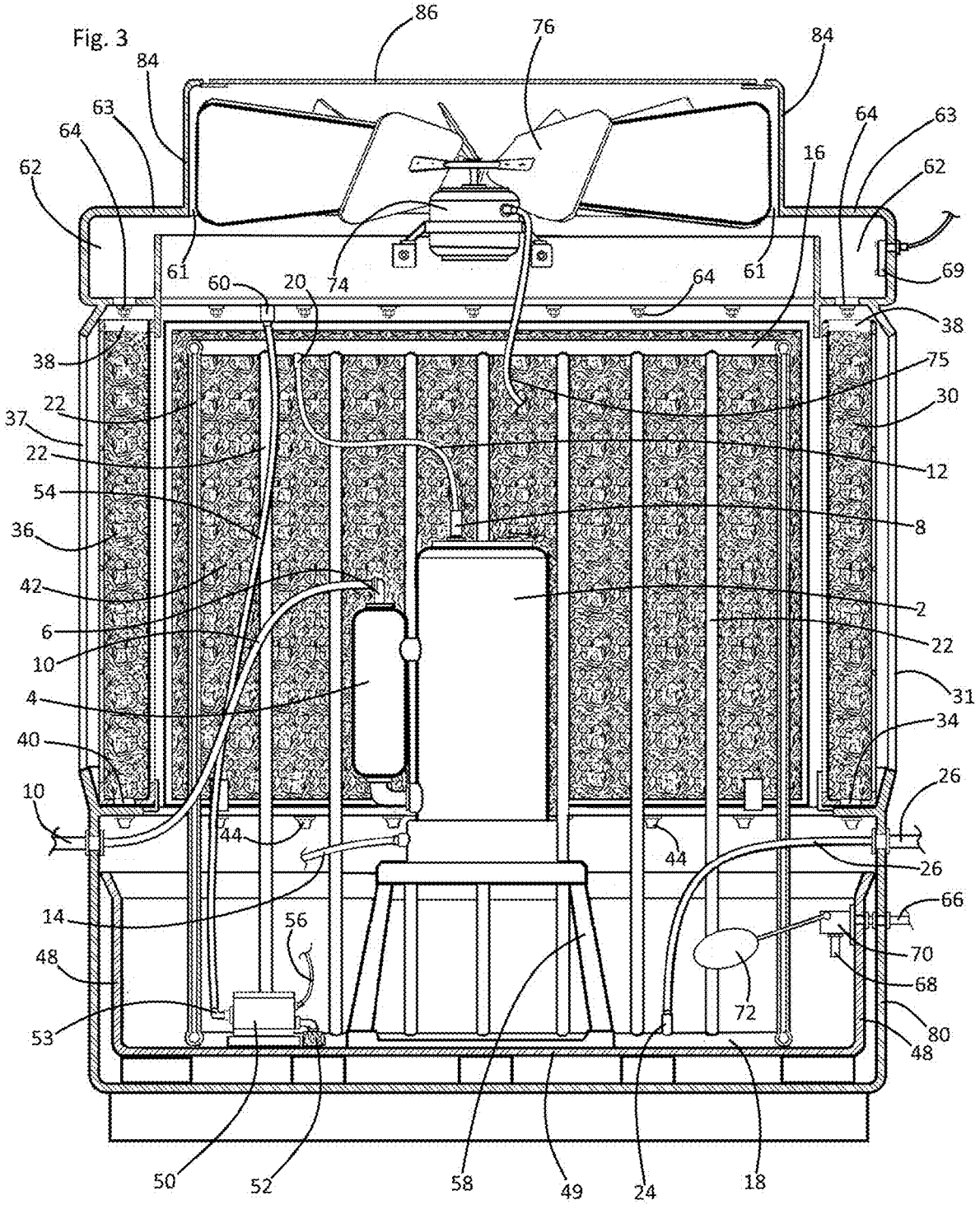
FIG. 3 is a sectional view as indicated in FIG. 1.

Referring now to the drawings, and in particular to drawing FIG. 1, a preferred embodiment of the instant inventive air conditioner condenser unit is referred to generally by reference arrow 1. Referring further simultaneously to FIGS. 2 and 3, the air conditioner condenser unit 1 comprises an interior electric motor driven compressor 2 which is housed within a case 80. An electrically conductive cable 81 extends to the case 80 to supply electric power to interior fan, pump, and compressor components, as explained below. Warmed gaseous air conditioner refrigerant within a refrigerant input line 10 extends from an evaporator unit within a residence or building (not depicted within views), such evaporator unit constituting a component of an air conditioning system which includes the instant invention's condenser unit 1.

The refrigerant input line 10 extends to a suction or intake port 6 at an upper end of an accumulator component 4 of the compressor 2. Refrigerant flowing from the accumulator 4 is compressed within compressor 2 by reciprocating, scrolling, rotary, or centrifugal gas compressing elements (not depicted within views) which are housed and operatively supported within the compressor. Upon compression, the refrigerant becomes heated, and exits at a refrigerant discharge port 8. A refrigerant output tube 12 extending from port 8 communicates with an intake port 20 of an upper manifold component 16 of a condenser tube matrix. Such tube matrix preferably further comprises a multiplicity of vertically extending connector tubes 22, each such tube forming a t-joint connection with the upper manifold 16. The matrix's connector tubes 22 extend downwardly to form lower t-joints which communicate with the matrix's lower refrigerant manifold 18. An output port 24 opens the lower manifold 18, such port 24 communicating with refrigerant output tube 26. The output of the invention's condenser tube matrix extends via tube 26 toward and enters the home or building to supply relatively cooled refrigerant to the air conditioning system's indoor evaporator unit.

The instant inventive condenser unit comprises at least a first evaporative cooling pad or panel 30, and preferably further incorporates a plurality of second evaporative cooling panels 36, 42, and 46. Provision of such plurality of evaporative cooling panels is preferred to allow the panels to surround the condenser tube matrix 16, 18, 22. Each of the evaporative cooling panels preferably comprises a loose matrix of fibrous or porous materials such as *excelsior*, wood wool, or open cell polyurethane foam. The interior matrixes of the evaporative cooling panels are preferably capable of facilitating downward flows of water therethrough while simultaneously facilitating lateral and inward flows therethrough of evaporating air. The upper ends of the evaporative cooling panels preferably include open water intake ports 32 and 38, and the panels' lower ends preferably include open water outlet ports 34, 40, and 44.

In the preferred embodiment, the evaporative cooling panels' lower output ports 34, 40, and 44 overlie an upper opening of a water basin or reservoir 48 which is mounted at the lower end of the interior of the case 80. A submersible electric motor driven pump 50 mounted within the reservoir 48 has an intake port 52 at or near the reservoir's floor 49, such pump having an output 53 which communicates with a water line 54. Electrical power to the pump 50 is supplied by electrical conductor 56.

Figure 4:
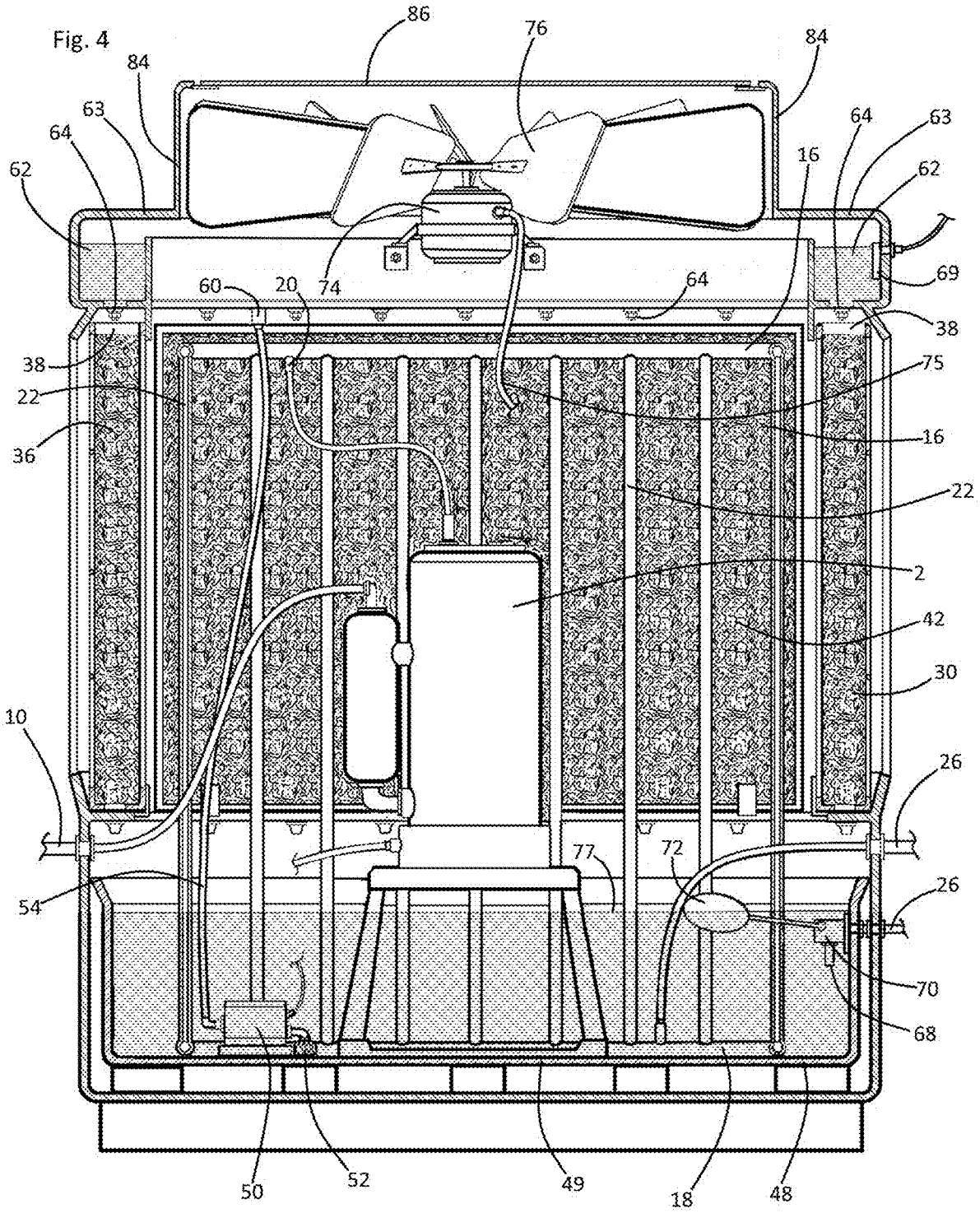
FIG. 4 presents an alternative configuration of the structure of FIG. 3.

Referring to FIGS. 3 and 4, a water supply line 66 extends to and through the case 80 to enter the reservoir 48, such supply line having a reservoir input port or opening 68 positioned for filling the reservoir. A buoyant float actuator arm 72 is mechanically associated with a shut off valve 70 which is connected operatively to the supply line 66, such float actuated arm and valve assuring that an upper water level 77 within the reservoir 48 is substantially continuously maintained. Upon gravity actuated downward pivoting of the float actuator 72, valve 70 is opened, allowing water from supply line 66 to emit at input port 68, thereby filling the reservoir 48. Upon filling of the reservoir toward the upper water level 77, the arm 72 buoyantly raises, closing valve 70 and preventing overfilling of the reservoir.

The upper end of the case 80 suitably forms a water receiving and dispersing plenum 62 whose lower end is opened by a plurality of adjustable water output ports 64, each such port preferably overlying an upper intake end or port 38 of one of the evaporative cooling panels 30, 36, 42, and 46. In operation of the units' water circulation system, water pumped upwardly by the submersible pump 50 from the reservoir 48 through supply line 54 to enter the water receiving and dispensing plenum 62 at intake port 60. The water within the plenum 62 then emits or exits at output ports 64 to downwardly flow into the open upper ends of the unit's evaporative cooling panels 30, 36, 42, and 46. In a suitable embodiment, the pump 50 may be electrically operatively controlled by a water level sensing limit switch 69 which is electrically and operatively connected at a side wall of the plenum 62. Such sensor switch 69 provides intermittent operation of the pump 50, assuring that the ports 64 of the plenum 62 are continuously supplied with water, and assuring that the plenum 62 does not overfill. In a suitable alternative configuration, an upper output end of a supply line extending from the pump 50 may be branched to include multiple output ends (not depicted within views), such outputs being positioned at and spaced along the upper input ends of panels 30, 36, 42 and 46.

Portions of the water which are dispersed by the preferably provided water dispersing plenum 62 which are not evaporated prior to completion of their downward passage through the cooling panels 30, 36, 42, 46, downwardly exits at outlet ports 44 to pass into the upper opening of the water reservoir 48. Accordingly, in operation of the instant inventive unit, evaporatively cooled water continuously flows downwardly though the evaporative cooling panels, and excess chilled unevaporated water flows and collects within the underlying reservoir 48.

The upper end or ceiling 63 of the case 80 is preferably opened by an air outlet port 61 whose periphery forms a fan shroud or housing 84. A rotary fan 76 is operatively driven by an electric motor 74 whose electric power is supplied by power line 75, the fan 76 and motor 74 being mounted for rotary operation within housing 84. Upon powered rotation of the fan 76, air is driven upwardly out of the case 80 and through an upper grate 86, such air having been drawn inwardly into the case 80 through side wall intake ports 31, 37, 41, and 47. The inwardly drawn air is advantageously evaporatively cooled by panels 30, 36, 42, and 46 prior to inwardly impinging against the vertical connector tubes 22 of the refrigerant condensing tube matrix.

The evaporatively cooled air advantageously directly impinges against the relatively warm upper ends of the matrix's connector tubes 22, thereby efficiently cooling the refrigerant therein. Upon such cooling, the refrigerant within the connector tubes becomes relatively dense, resulting in negative buoyancy which downwardly biases the refrigerant. The relatively cool lower ends of the tubes 22 are simultaneously cooled by direct immersion within the chilled unevaporated water output of the evaporative cooling panels. Such chilled water downwardly emits from the lower output ports 44 of the evaporative cooling panels to collect within the reservoir 48, and to directly cool the lower ends of the matrix of refrigerant condensing tubes. Accordingly, the instant inventive condenser unit advantageously provides, in place of the direct air cooling provided by conventional air conditioning systems, dual and enhanced modes of refrigerant coil cooling comprising upper evaporatively cooled air cooling and lower chilled water contact cooling. The connector tubes' preferred vertical orientation allows the less buoyant cooled refrigerant to flow downwardly through the connector tubes 22, advantageously enhancing flow efficiency within the tube matrix.

In a preferred embodiment, a pedestal 58 extending upwardly from the floor 49 of the reservoir 48 supports the compressor 2, such pedestal advantageously positioning the compressor centrally with respect to the refrigerant condensing connector tubes 22 and with respect to the evaporative cooling panels. In the preferred embodiment, the pedestal 58 has a vertical dimension sufficient to hold the compressor above the reservoirs' upper water level 79, while positioning the upper end of the compressor below the upper end of the condenser tube matrix. Such preferred dimension of the pedestal 58 advantageously isolates the compressor 2 from the underlying liquid water while holding the compressor 2 within a stream of inwardly and upwardly flowing evaporatively cooled air.

While the principles of the invention have been made clear in the above illustrative embodiment, those skilled in the art may make modifications to the structure, arrangement, portions, components, and method steps of the invention without departing from those principles. Accordingly, it is intended that the description and drawings be interpreted as illustrative and not in the limiting sense, and that the invention be given a scope commensurate with the appended claims.

The invention claimed is:

1. An air conditioner condenser unit comprising:

a. a refrigerant compressor having an output port communicating with an output tube;

b. a matrix of refrigerant condensing tubes having an upper end comprising an input manifold, and having a lower end comprising an output manifold, said tube matrix having an input port communicating with the output tube;

c. at least a first evaporative cooling panel overlying the matrix of refrigerant condensing tubes;

d. a blower positioned for moving air through the at least first evaporative cooling panel, and positioned for moving the air toward the matrix of refrigerant condensing tubes;

e. a water reservoir receiving the refrigerant condensing tube matrix's output manifold;

f. A circulation pump operatively mounted for transferring water from the water reservoir to the at least first evaporative cooling panel; and;

g. a plurality of connector tubes extending linearly between said manifolds.

2. The air conditioner condenser unit of claim 1, wherein the connector tubes are substantially vertically oriented.

3. The air conditioner condenser unit of claim 1, wherein the water reservoir has a floor, and wherein the lower output manifold overlies said floor.

4. The air conditioner condenser unit of claim 1, further comprising a case having a plurality of side walls, each side wall being positioned outwardly from the matrix of refrigerant condensing tubes.

5. The air conditioner condenser unit of claim 4, wherein the at least first evaporative cooling panel is positioned outwardly from the matrix of refrigerant condensing tubes.

6. The air conditioner condenser unit of claim 5, wherein the case is opened by a plurality of air inlet ports, and further comprising a plurality of second evaporative cooling panels, each panel among the at least first and plurality of second evaporative cooling panels being supported at one of the air inlet ports.

7. The air conditioner condenser unit of claim 6, wherein the water reservoir has an upper water level, and wherein the refrigerant compressor overlies said level.

8. The air conditioner unit of claim 7, wherein the refrigerant compressor is positioned inwardly from the connector tubes.

9. The air conditioner condenser unit of claim 8, wherein the case is further opened by an air outlet port, and wherein the blower is operatively mounted at said port.

10. The air conditioner condenser unit of claim 9, wherein the blower comprises an electric motor driven fan.

11. The air conditioner condenser unit of claim 10, wherein each evaporative cooling panel has a lower water output end overlying the water reservoir.

12. The air conditioner condenser unit of claim 11, wherein the circulation pump comprises a submersible pump mounted within the water reservoir.

13. The air conditioner condenser unit of claim 12, further comprising water supply means incorporating the water reservoir and the circulation pump, the water supply means having a water input positioned for directing flows of water into the water reservoir.

14. The air conditioner condenser unit of claim 13, wherein the water supply means comprise a float actuated valve connected operatively to the water supply means' water input.

15. The air conditioner condenser unit of claim 14, wherein the water supply means further comprise a water dispensing plenum overlying the evaporative cooling panels, the water circulation pump having an output connected operatively to said plenum.

16. The air conditioner condenser unit of claim 15, further comprising a pedestal extending upwardly from the water reservoir's floor, the pedestal holding the refrigerant compressor above the water reservoir's upper water level.

* * * * *